US006422299B1

(12) United States Patent
Eriksson

(10) Patent No.: US 6,422,299 B1
(45) Date of Patent: Jul. 23, 2002

(54) WHEEL SYSTEM FOR AN AIR HANDLING UNIT

(75) Inventor: Krister Eriksson, Tampa, FL (US)

(73) Assignee: Thermotech Enterprises, Inc., Oldsmar, FL (US)

( * ) Notice: Subject to any disclaimer, the term of this patent is extended or adjusted under 35 U.S.C. 154(b) by 0 days.

(21) Appl. No.: 09/993,538

(22) Filed: Nov. 6, 2001

(51) Int. Cl.[7] ..... F23L 15/02
(52) U.S. Cl. ..... 165/8; 165/10
(58) Field of Search ..... 165/6, 8, 10, DIG. 16

(56) References Cited

U.S. PATENT DOCUMENTS 3,267,562 A * 8/1966 Chiang et al. ..... 165/10
3,789,916 A * 2/1974 Lindahl ..... 165/8
3,891,029 A * 6/1975 Mahoney ..... 165/8
3,998,266 A * 12/1976 Finnemore ..... 165/10
4,418,742 A * 12/1983 Conde et al. ..... 165/8
4,960,166 A * 10/1990 Hirt ..... 165/8
6,155,334 A 12/2000 Steele
6,237,674 B1 * 5/2001 Larkin et al. ..... 165/10
6,257,318 B1 * 7/2001 Fierle et al. ..... 165/8
6,260,607 B1 * 7/2001 Finnemore ..... 165/8

* cited by examiner

*Primary Examiner*—Henry Bennett
*Assistant Examiner*—Terrell McKinnon
(74) *Attorney, Agent, or Firm*—Dennis G. LaPointe; Mason & Associates, P.A.

(57) ABSTRACT

A rotary wheel system, including a rotatable frame with a plurality of removable, interchangeable media segments, has a hub assembly, a plurality of spokes radially extending from the hub assembly, in between which each media segment is located. Each I-beam shaped spoke is formed of a primary spoke and a secondary spoke, separated along the center section. The hub assembly includes specially designed brackets for detachably connecting the spokes to the hub assembly. A rim assembly includes a plurality of rim segments and special brackets for fastening each end of each rim segment to the spokes. It is emphasized that this abstract is provided to comply with the rules requiring an abstract that will allow a reader to quickly ascertain the subject matter of the technical disclosure and will not be used to interpret or limit the scope of meaning of the claims. 37 CFR 1.72(b).

69 Claims, 8 Drawing Sheets

WHEEL SYSTEM FOR AN AIR HANDLING UNIT

The invention relates to a wheel system for use in air handling units, such as for a rotary heat exchanger or for dehumidification purposes, having an improved construction in the area of the hub joint assembly, the spoke design, the rim joint assembly and the combination of hub, spoke and rim assembly.

Current designs for the construction of the such rotary wheels inherently have many shortcomings. For example, mechanical endurance or product fatigue life is adversely affected by the transfer media working loose in the support structure and self-destruction against the stationary casing frame. In addition, product operating efficiency or performance is adversely affected. Special tooling is required during field installations that is best suitable for factory assembly due to a general lack of proper access to the wheels. Further, retrofit work on large air systems in critical areas such as hospital operating rooms, etc., can cause long shut down times. There are cost savings associated in an improved construction that allows for reduced installation labor and travel expenses. In addition, improved efficiency increases energy savings per user and longer product life reduces maintenance costs and future repair expenses. The present invention described herein is suitable for use in field installations of new equipment or for retrofit of old units.

Typically, the rotary wheel or "Thermo-Wheel System" includes a rotor support structure, a drive base assembly and an air seal assembly. The key components consist of aluminum and rubber extrusions joined together with mechanical bonds, welding or bolting together.

The invention may be described as a rotary wheel system comprising a rotatable frame having a rotation axis, and a media matrix comprising a plurality of removable, interchangeable media segments.

The rotatable frame includes a hub assembly having a circular portion, and a plurality of spokes radially extending from said circular portion of the hub assembly, in between which each media segment is located.

Each spoke generally has an I-beam cross-section with two spaced-apart flanges perpendicular to a center section. Each spoke is formed of a primary spoke and a secondary spoke, separated along the center section, typically proximate the secondary spoke flange. Each primary spoke is fixed at one end to hub joint means for fastening the primary spoke to a portion of the circular portion of the hub assembly. Fastening means for joining each secondary spoke to each respective primary spoke are provided.

The invention also includes a rim assembly, which includes a plurality of rim segments. Rim joint fastening means for fastening each end of each rim segment to one of the plurality of spokes are also provided.

Each media segment is compressed within a generally pie-shaped formed portion of the rotatable frame bounded by the hub assembly, two radially extending spokes and one of the rim segments.

Each primary spoke has two spaced-apart opposed recesses running longitudinally substantially from the one end of the center section of the primary spoke fixed to the hub joint means to an opposite end of the center section of the primary spoke.

Each primary spoke further comprises two spaced-apart slots at the opposite end of the center section, each slot having a fastening member fixed therein aligned so as to engage with the rim joint fastening means.

The inside surfaces of each side of the primary and secondary spokes include serrations against which segments of the media matrix is compressed for preventing movement of the matrix segments during operation of the rotary wheel system. Each segment of the media matrix is compressed so as to be squeezed within each recess of the primary spoke bounding and facing the segment of the media matrix.

The hub assembly includes a shaft portion and the circular portion has a continuous surface across which the hub joint means interfaces. The hub assembly shaft portion and circular portion may be comprised of two spaced-apart circular discs, an outer surface of each disc being circular, the hub joint means interfacing with said outer surfaces and extending from one disc to the other.

The hub joint means comprises a spoke support structural member. The spoke support structural member has a groove portion at an approximate center of said spoke support structural member. The groove portion extends longitudinally across the spoke support structural member and receives the primary spoke, which is fixed thereto.

The spoke support structural member further has an arcuate surface for interfacing with the circular portion of the hub assembly. The arcuate surface has an alignment groove in which two spaced-apart alignment pins, each fixed to the circular portion of the hub assembly extend into the alignment groove. The spoke support structural member is fastened to the circular portion of the hub assembly.

The fastening means for joining each secondary spoke to its corresponding primary spoke is typically a plurality of spaced-apart bolts secured from a top of the flange for the secondary spoke through said flange into the center section of the primary spoke.

Each rim joint fastening means comprises a spoke rim bracket member, which has a surface interfacing with the opposite end of the center section of a spoke. The spoke rim bracket member has two spaced-apart apertures into which bolts are inserted for fastening the spoke rim bracket member to the fastening members in each center section slot.

Each rim joint fastening means further comprises a pair of rim segment retaining brackets, each being generally L-shaped with two spaced-apart apertures on one of a leg of each of the L-shaped rim segment retaining brackets through which fasteners are inserted to secure one end of one of the rim segments to the spoke rim bracket member and to secure one end of an adjacent rim segment to the spoke rim bracket member.

Each rim joint fastening means further comprises a longitudinal semicircular recess on two corners of each spoke rim bracket member on the spoke side of the spoke rim bracket member, a circular rod positioned in each recess, and two spaced-apart threaded holes in each rod. Each spoke rim bracket member further has four spaced-apart diagonal bores, two on each side of the each spoke rim bracket member, the bores aligned to enter the semicircular recesses. Fasteners which secure each end of adjacent rim segments to the spoke rim bracket member are inserted through the diagonal bores and threaded into the threaded holes in the circular rod. The four spaced-apart diagonal bores would typically extend through the spoke rim bracket member at an angle of from about 25 degrees to about 30 degrees relative to each end of the adjacent rim segments.

Each spoke rim bracket member also has a longitudinal recessed portion of sufficient depth such that heads of the bolts fastened into the center section of the spoke underlie each end of adjacent rim segments attached to said spoke rim bracket member. In addition, the spoke rim bracket member further has an intermediate recessed portion perpendicular to the longitudinal recessed portion, the intermediate recessed portion being of sufficient depth so as to underlie belt drive grooves in each adjacent rim segment attached to the spoke rim bracket member.

The leg of each L-shaped rim segment retaining bracket with the two spaced-apart holes through which fasteners are inserted to secure the one end of one of the rim segments to the spoke rim bracket member and to secure the one end of the adjacent rim segment to the spoke rim bracket member further has a recessed portion of sufficient depth so as to underlie one or more belt drive grooves in each adjacent rim segment attached to said spoke rim bracket member.

Each rim segment is arcuate-shaped with a generally C-channel configuration, and each rim segment further has one or more belt drive grooves approximately centered and extending from one end of each segment to the another end of said segment.

The spoke rim bracket member further has cut-out portions on each end of said spoke rim bracket member into which a portion of each outside leg of the generally C-shaped channel configured rim segment depends.

The rim assembly further comprises a generally C-shaped channel member extending generally along the length of each rim segment in an underlying relationship to the rim segment and its one or more belt drive grooves. The generally C-shaped channel member has a flat surface against which the media segment is compressed.

In an alternative embodiment, the shaft portion may be a detachable split shaft mechanically coupled to each side of the circular portion of the hub assembly.

The outside surfaces of each side of the primary and secondary spokes may also include serrations which causes a higher resistance to air leakage from one air stream to the other as the spokes passes by a seal in the equipment housing of the wheel system.

Figure 1:
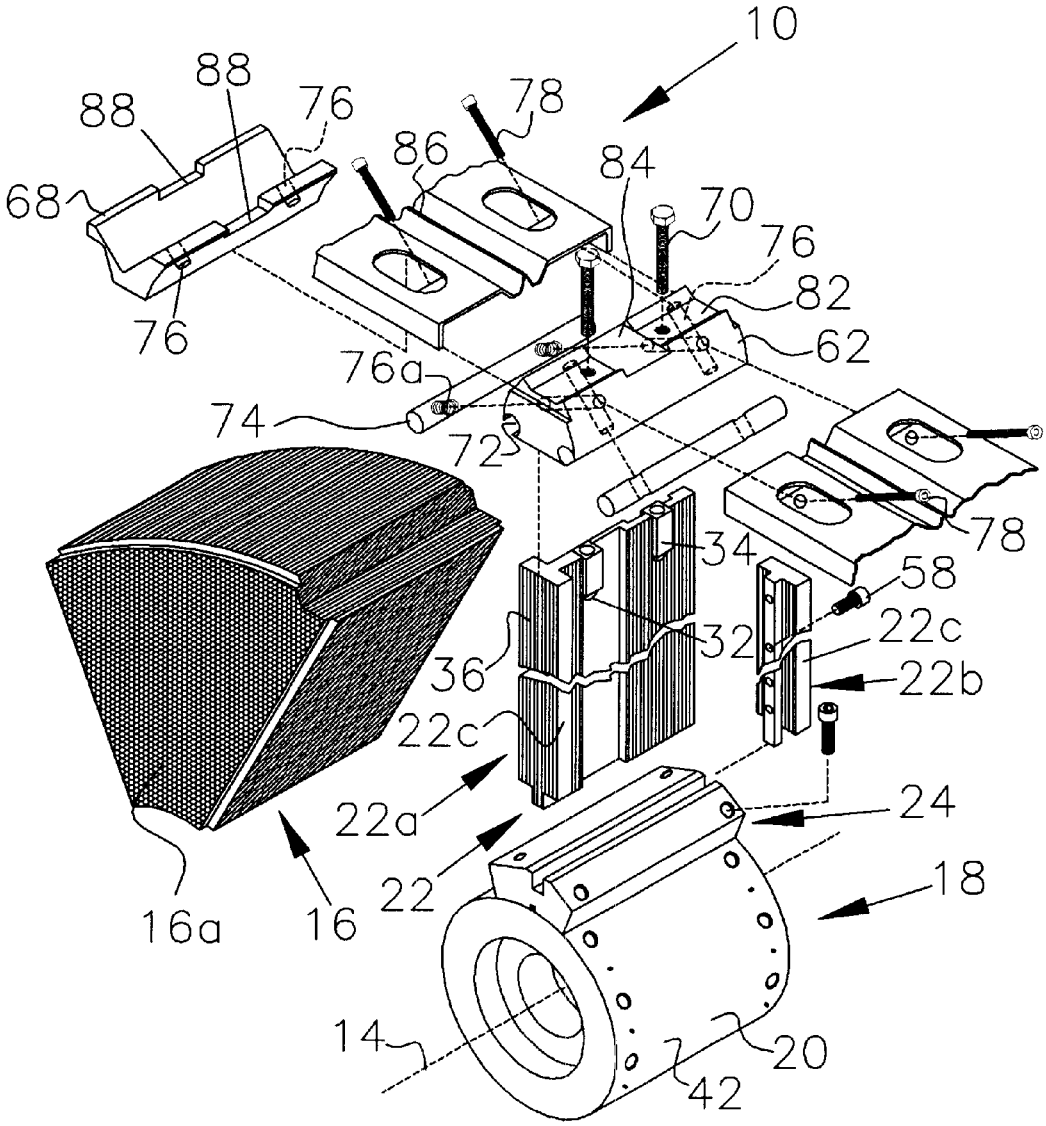
FIG. 1 is an exploded break down perspective view of the major components of a portion of the heat wheel system.
Figure 2A:
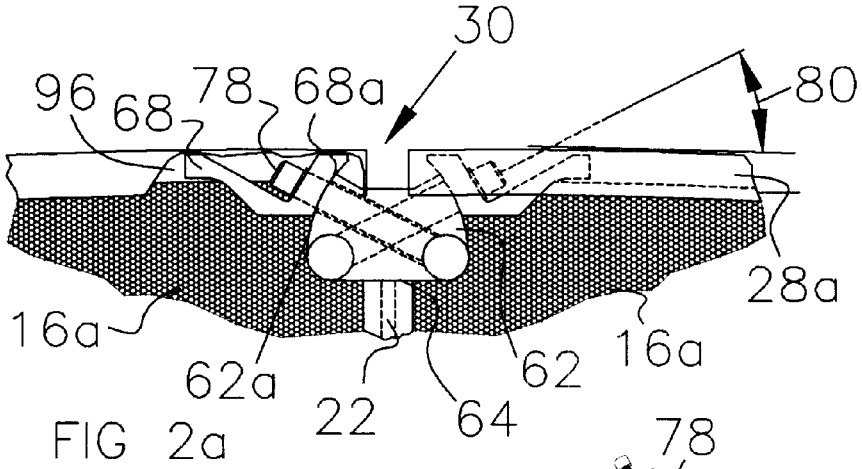
FIG. 2 is a partially assembled view of the components of FIG. 1.
Figure 2:
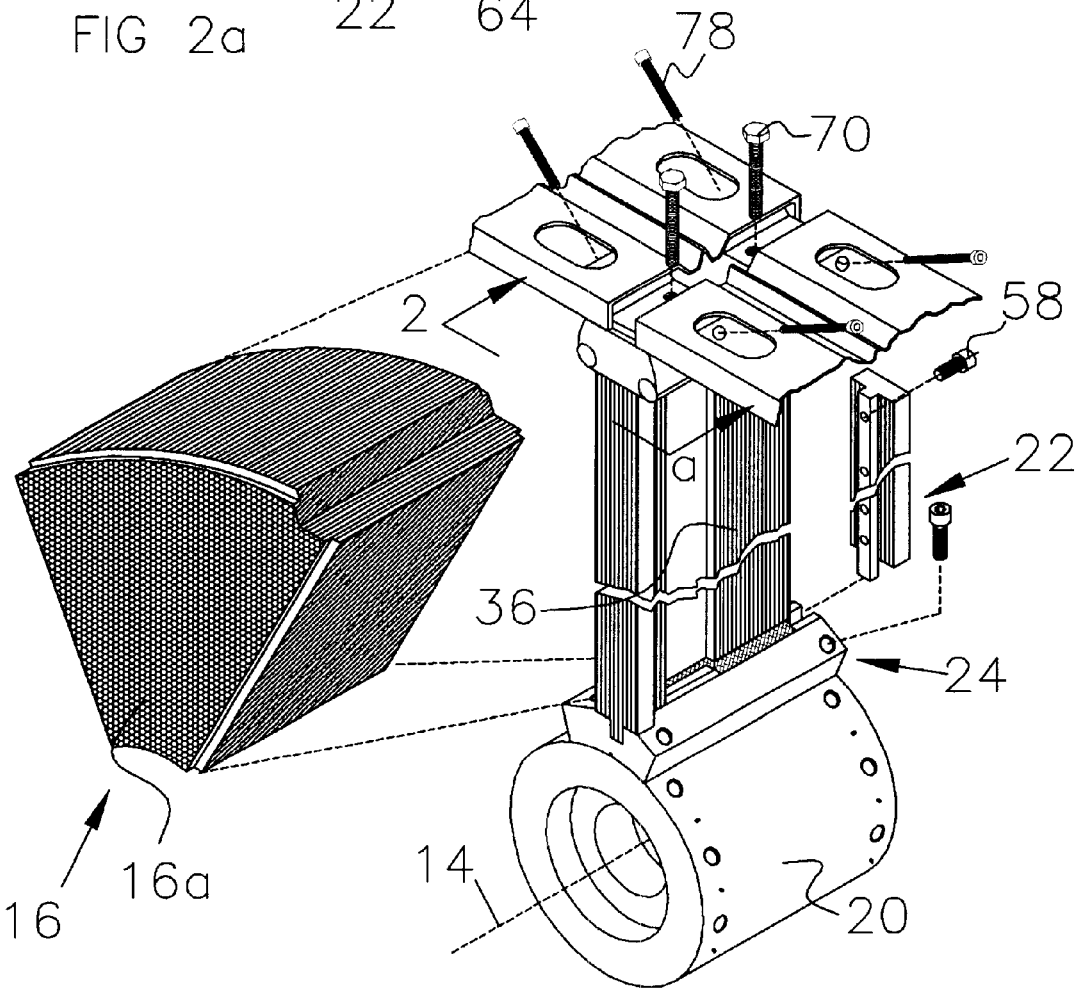
Figure 3:
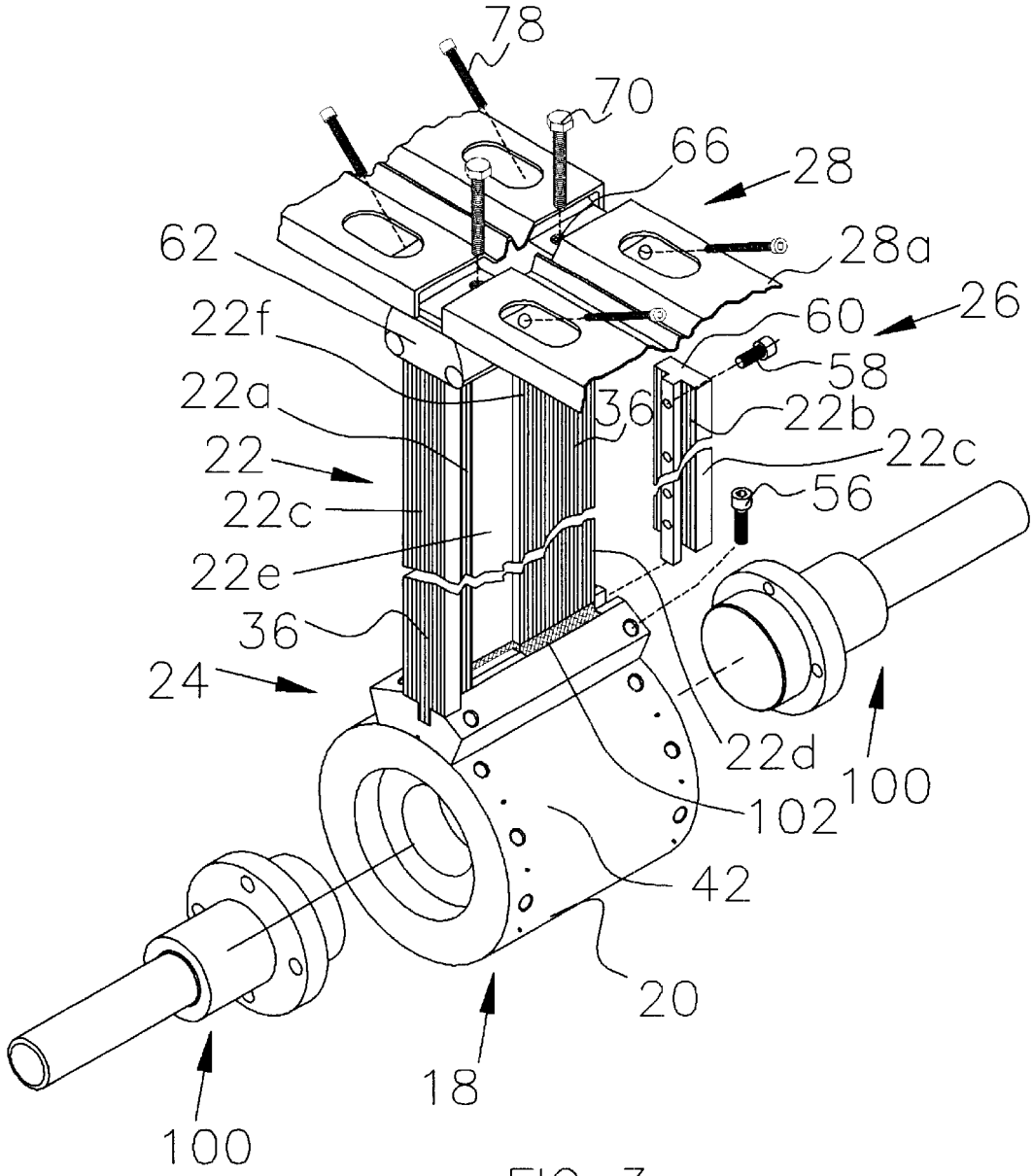
Figure 4:
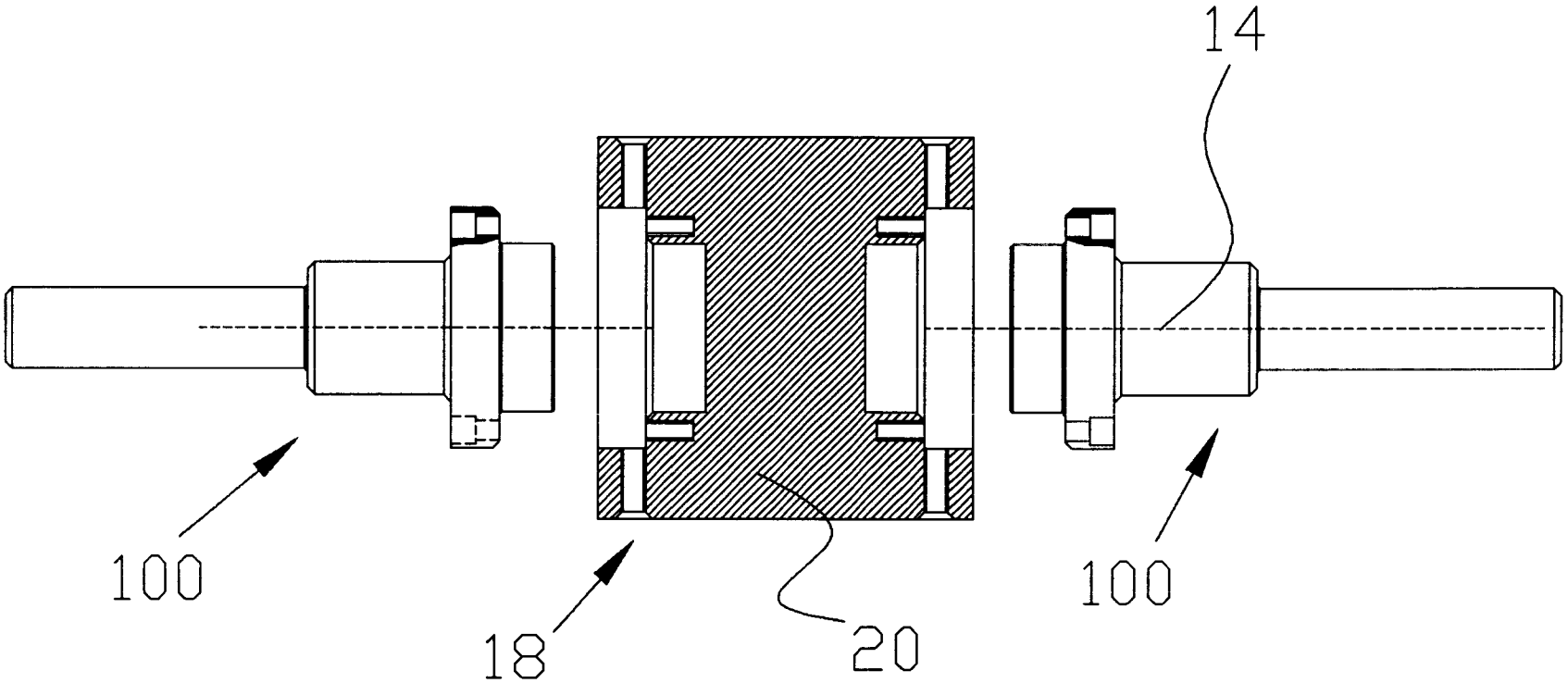
Figure 5:
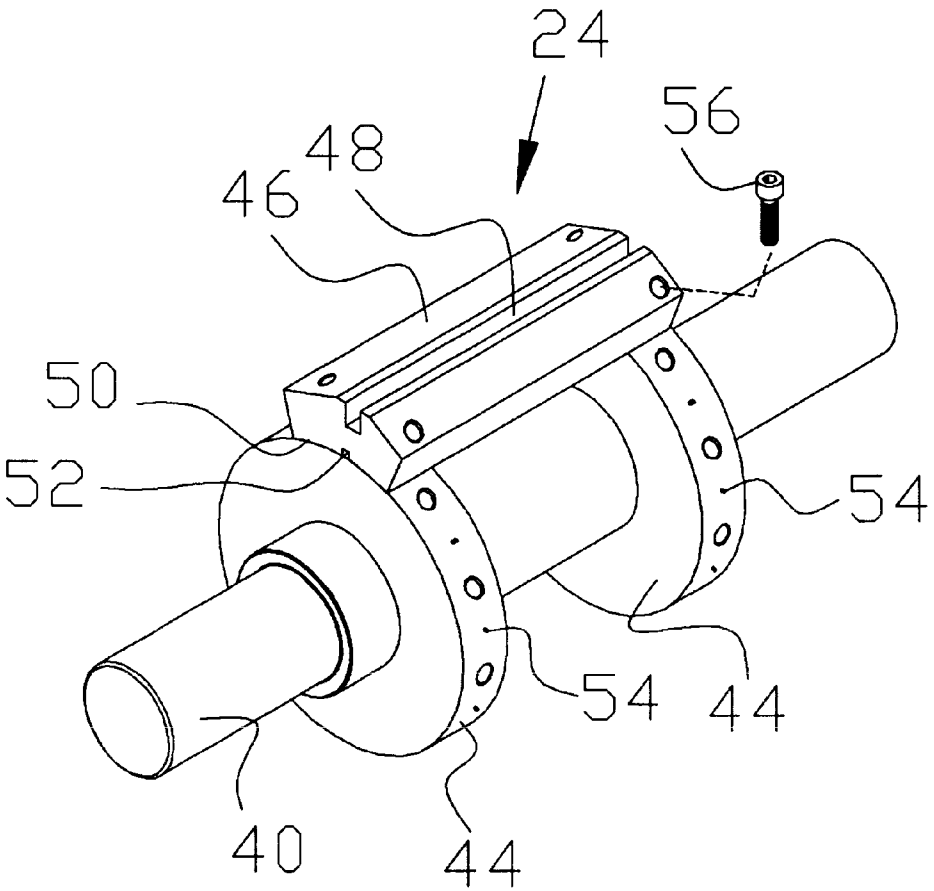
Figure 6:
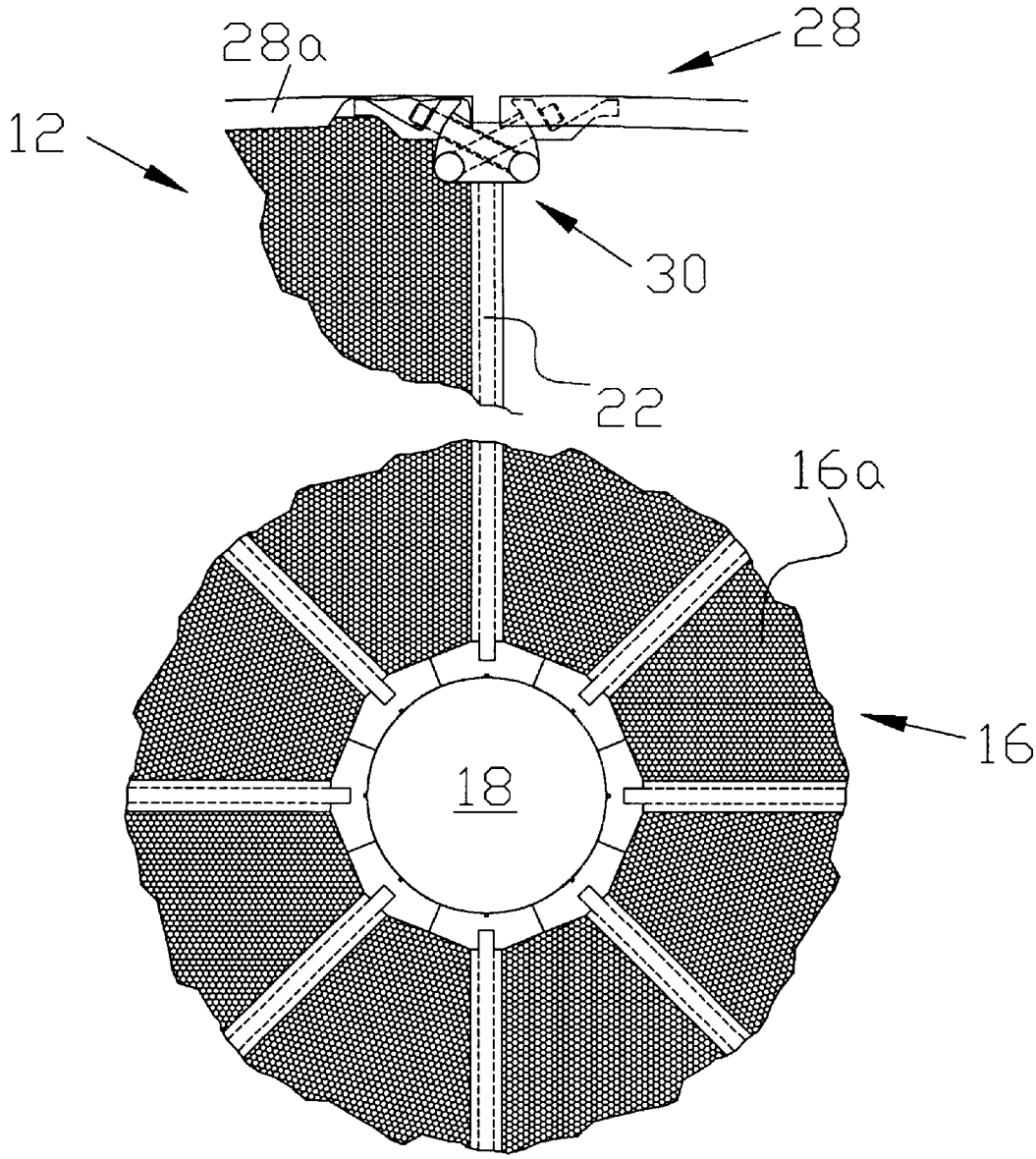
Figure 7A:
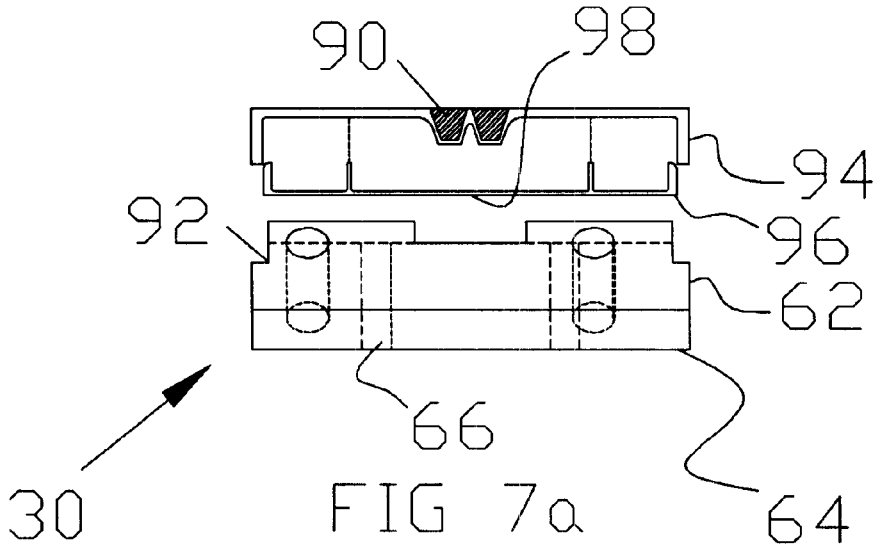
Figure 7:
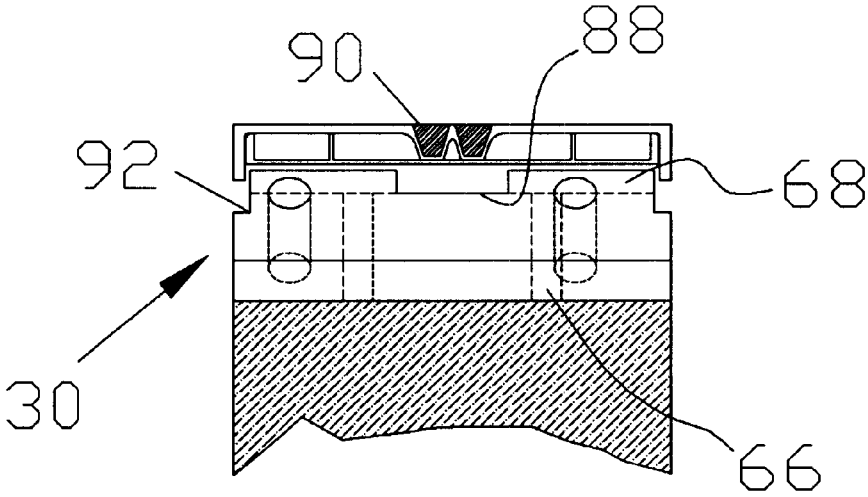
Figure 8:
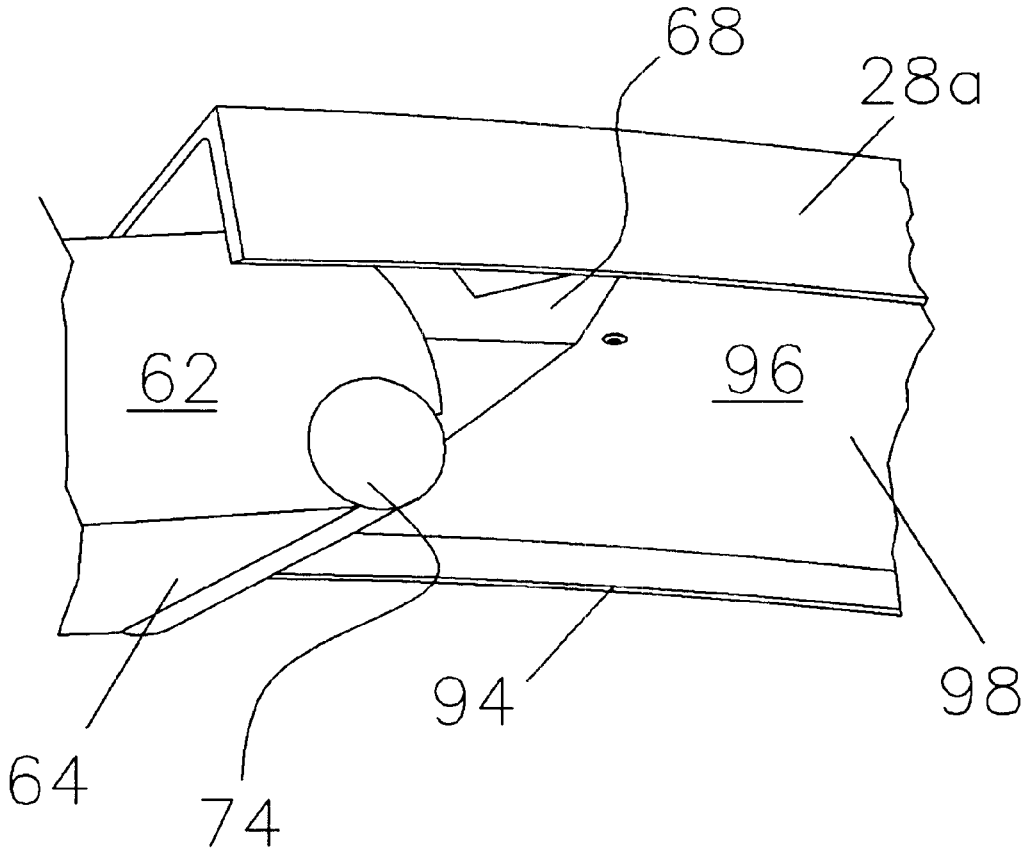

FIG. 2*a* is a partial side view taken from view 2-*a* of FIG. 1 depicting the media in place between the rim segments and spoke;

FIG. 3 is a depiction of FIG. 2 with the addition of a split shaft embodiment to the hub assembly;

FIG. 4 is a depiction of the split shaft hub assembly embodiment;

FIG. 5 depicts another embodiment of the hub assembly using two spaced-apart discs;

FIG. 6 is a conceptual partial view of the present invention;

FIG. 7 is a partial cross-sectional view of the rim joint fastening means with the overlying rim assembly;

FIG. 7*a* is an exploded end view of the rim assembly components in relationship to the rim joint fastening means; and FIG. 8 is a partial view of the underside of one side of a rim segment attached to the rim join fastening means.

Referring now to the drawings, in particular FIGS. 1–3, 6 and 8, the present invention may be described as a rotary wheel system, generally depicted as 10, comprising a rotatable frame 12 having a rotation axis 14, and a media matrix 16 comprising a plurality of removable, interchangeable media segments 16*a*.

The rotatable frame 12 includes a hub assembly 18, which has a circular portion 20 and a plurality of spokes 22 radially extending from the circular portion 20 of the hub assembly 18, in between which each media segment 16*a* is located.

Each spoke 22 generally has an I-beam cross-section with two spaced-apart flanges 22*c* perpendicular to a center section 22*d*. Each spoke 22 is formed of a primary spoke 22*a* and a secondary spoke 22*b*, separated along the center section 22*d*. Each primary spoke 22*a* is fixed at one end to hub joint means 24 for fastening the primary spoke 22*a* to a portion of the circular portion 20 of the hub assembly 18. Fastening means 26 for joining each secondary spoke 22*b* to each respective primary spoke 22*a* are provided.

The invention also includes a rim assembly 28, which includes a plurality of rim segments 28*a*. Rim joint fastening 30 for fastening each end of each rim segment 28*a* to one of the plurality of spokes 22 are also provided.

Each media segment 16*a* is compressed within a generally pie-shaped formed portion of the rotatable frame 12 bounded by the hub assembly 18, two radially extending spokes 22 and one of the rim segments 28*a*.

Each primary spoke 22*a* has two spaced-apart opposed recesses 22*e* running longitudinally substantially from the one end of the center section 22*d* of the primary spoke 22*a* fixed to the hub joint means 24 to an opposite end of the center section 22*d* of the primary spoke 22*a*.

Each primary spoke 22*a* further comprises two spaced-apart slots 32 at the opposite end of the center section 22*d*, each slot 32 having a fastening member 34 fixed therein aligned so as to engage with the rim joint fastening means 30. The inside surfaces 22*f* of each side of the primary and secondary spokes 22*a*, 22*b* include serrations 36 against which segments 16*a* of the media matrix 16 are compressed for preventing movement of the matrix segments 16*a* during operation of the rotary wheel system 10. Each segment 16*a* of the media matrix 16 is compressed so as to be squeezed within each recess 22*e* of the primary spoke 22*a* bounding and facing the segment 16*a* of the media matrix 16.

The hub assembly 18 includes a shaft portion 40 (see FIG. 5) and the circular portion 20 has a continuous surface 42 across which the hub joint means 24 interfaces. The hub assembly shaft portion 40 and circular portion 20 may be comprised of two spaced-apart circular discs 44, an outer surface of each disc 44 being circular, the hub joint means 24 interfacing with said outer surfaces and extending from one disc 44 to the other.

The hub joint means 24 comprises a spoke support structural member 46. The spoke support structural member 46 has a groove portion 48 at an approximate center of said spoke support structural member 46. The groove portion 48 extends longitudinally across the spoke support structural member 46 and receives the primary spoke 22*a*, which is fixed thereto. The preferred method of fixing the primary spoke 22*a* to the spoke support structural member 46 is by welding the center section 22*d* inside the groove portion 48 as shown at 102 of FIG. 3.

The spoke support structural member 46 further has an arcuate surface 50 for interfacing with the circular portion 20 of the hub assembly 18. The arcuate surface 50 has an alignment groove 52 in which two spaced-apart alignment pins 54, each fixed to the circular portion 20 of the hub assembly 18 extend into the alignment groove 52. The spoke support structural member 46 is fastened to the circular portion 20 of the hub assembly 18 using bolts 56.

The fastening means 26 for joining each secondary spoke 22*b* to its corresponding primary spoke 22*a* is typically a plurality of spaced-apart bolts 58 secured from a top 60 of the flange 22*c* for the secondary spoke 22*b* through said flange 60 into the center section 22*d* of the spoke 22. The primary spoke center section 22*b* may have a thickened area (not shown), which is tapped to receive bolts 58. This thickened area may be accomplished in a number of ways known in the art, including by extrusion when the spoke 22 is drawn or by welding a boss plate which is tapped to receive bolt 58.

Referring to the above drawings and FIGS. 7 and 7*a*, each rim joint fastening means 30 comprises a spoke rim bracket member 62, which has a surface 64 interfacing with the opposite end of the center section 22*d* of a spoke 22. The spoke rim bracket member 62 has two spaced-apart apertures 66 into which bolts 70 are inserted for fastening the spoke rim bracket member 62 to the fastening members 34 in each center section slot 32.

Each rim joint fastening means 30 further comprises a pair of rim segment retaining brackets 68, each being generally L-shaped with two spaced-apart apertures 76 on one of a leg of each of the L-shaped rim segment retaining brackets 68 through which fasteners 78 are inserted to secure one end of one of the rim segments 28*a* to the spoke rim bracket member 62 and to secure one end of an adjacent rim segment 28*a* to the same spoke rim bracket member 62.

Each rim joint fastening means 30 further comprises a longitudinal semicircular recess 72 on two corners of each spoke rim bracket member 62 on the spoke 22 side of the spoke rim bracket member 62, a circular rod 74 positioned in each recess 72, and two spaced-apart threaded holes 76*a* in each rod 74. Each spoke rim bracket member 62 further has four spaced-apart diagonal bores 76, two on each side of the each spoke rim bracket member 62, the bores 76 aligned to enter the semicircular recesses 72 for fastening bolts 78 into threaded bores 76*a* of the rods 74. That is, fasteners 78 which secure each end of adjacent rim segments 28*a* to the spoke rim bracket member 62 are inserted through the diagonal bores 76 and threaded into the threaded holes 76*a* in the circular rod 74. The four spaced-apart diagonal bores 76 would typically extend through the spoke rim bracket member 62 at an angle of from about 25 degrees to about 30 degrees relative to each end of the adjacent rim segments 28*a* as shown as 80 in FIG. 2*a*.

Each spoke rim bracket member 62 also has a longitudinal recessed portion 82 of sufficient depth such that heads of the bolts 70 fastened into the center section 22*d* of the spoke 22 underlie each end of adjacent rim segments 28*a* attached to said spoke rim bracket member 62. In addition, the spoke rim bracket member 62 further has an intermediate recessed portion 84 perpendicular to the longitudinal recessed portion 82, the intermediate recessed portion 84 being of sufficient depth so as to underlie belt drive grooves 86, in which one or more belts 90 used to drive the wheel 10 are placed and connected to the air handling unit drive means (not shown), in each adjacent rim segment 28*a* attached to the spoke rim bracket member 62.

The leg of each L-shaped rim segment retaining bracket 68 with the two spaced-apart holes 76 through which fasteners 78 are inserted to secure the one end of one of the rim segments 28*a* to the spoke rim bracket member 62 and to secure the one end of the adjacent rim segment 28*a* to the spoke rim bracket member 62 further has a recessed portion 88 of sufficient depth so as to underlie one or more belt drive grooves 86 in each adjacent rim segment 28*a* attached to said spoke rim bracket member 62.

Each rim segment 28*a* is arcuate-shaped with a generally C-channel configuration, and each rim segment 28*a* further has one or more belt drive grooves 86 approximately centered and extending from one end of each segment 28*a* to the another end of said segment 28*a*.

The spoke rim bracket member 62 further has cut-out portions 92 on each end of said spoke rim bracket member 62 into which a portion of each outside leg 94 of the generally C-shaped channel configured rim segment 28*a* depends.

The rim assembly 28 further comprises a generally C-shaped channel member 96 extending generally along the length of each rim segment 28*a* in an underlying relationship to the rim segment 28*a* and its one or more belt drive grooves 86. The generally C-shaped channel member 96 has a flat surface 98, as shown in FIG. 8, against which the media segment 16*a* is compressed.

In an alternative embodiment, the shaft portion 40 of the hub assembly 18 may be a detachable split shaft 100 mechanically coupled to each side of the circular portion 20 of the hub assembly 18 as shown in FIGS. 3 and 4.

The outside surfaces of each side of the primary and secondary spokes 22*a*, 22*b*, that is the outside surfaces of the flanges 22*c*, may also include serrations 36 which causes a higher resistance to air leakage from one air stream to the other as the spokes 22 passes by a seal in the air handling equipment housing the wheel system 10.

By way of understanding the nature and typical dimensional aspects of the invention, the following description of various components of the invention follows. The primary spoke 22*a* can be manufactured as an extruded material. The flange 22*c* is typically about 1.75 inches wide by about ⅜" to ¾" thick. Serrations 36 on the flange 22*c* as well as the serrations on the inside surfaces 22*f* of the center section 22*d* are typically v-shaped and are about 0.02 inches deep by about 0.04 inches peak to peak. The overall cross-sectional height of the primary spoke 22*a* is typically about 5 to 11 inches and the recessed portions 22*e* are typically about 1⅛" to about 4⅛" in width and about 0.3 inches in depth. The thickness of the thickest portion of the center section 22*d* is about ½ inch. The secondary spoke 22*b* has a flange 22*c* which is generally the same as the flange 22*c* of the primary spoke 22*a*. It is T-shaped in that it has a small projected center section 22*d* which matches the center section 22*d* of the primary spoke 22*a*. The overall cross-sectional height of the secondary spoke 22*b*, including its flange 22*c*, is typically about one inch. The preferred material for spoke 22 is aluminum such as 6061-T6 material. Each spoke can be several feet in length, for example, it is not unusual that a spoke 22 has a seven foot length.

Generally, the media is being compressed into the rotor structure during the assembly process without causing any angular deformation and resulting misfits between the spokes and media parts. This is accomplished by the rim joints that provide the ability to pull each rim tight incrementally one at a time from one position by turning the rotor structure with all the media installed loosely. In a typical application, the media is held securely in place by the primary spokes, the secondary spokes, by an approximate ¼ inch inside lip of the outer rim and by the compressive force exerted inward by the rims squeezing the media against the serrations on the primary and secondary spoke surfaces eliminating any possible micro movement during its operation.

The product efficiency and performance is improved by the mechanical design of the hub/shaft and by the ability of the primary and secondary spokes to resist any rotor deflection due to the air pressure drop forces being exerted by the two air streams and thereby maintaining a constant seal gap clearance between the rotating and stationary parts preventing bypass and leakage of the air intended to go through the heat exchanger media.

Because the media is guided and secured along all edges, the overall flatness is improved resulting in tighter seal tolerances and less air leakage. This is further improved by the serrations on the outside surfaces of the primary and secondary spoke flanges causing a higher resistance to air leakage from one air stream to the other as the spokes pass by the seal.

The rubber seal extrusion (not shown) would typically be joined mechanically to an aluminum extrusion to increase its rigidity so that it can withstand pressure differences up to 12 in.wc. without deflecting and causing excessive leakage between the mounting surface and the seal itself. It would be securely kept in place by bolts, eliminating any possibility of getting blown out by the air pressure.

The self aligning rim joint design with its approximate 25 degree angular bolt system eliminates the use of a come-along or other types of rim pullers to compress and guide the rims and the media in place and still provide a smooth outer surface and avoid any interference with the stationary casing structure. The half round or arcuate-shaped mating surfaces 68*a,* 62*a* of one leg of each of the rim segment retaining brackets 68 and the spoke rim bracket member 62 allows retaining bracket 68 and bracket member 62 to join tightly together at the different approach angles required for different size rotors in the 5 feet to about 14 feet in diameter range.

The shutdown time is significantly reduced with the present invention by about 33 percent due to the following factors, among others. The air seals are typically secured by some kind of clip screwed or riveted on about every 6 inches or less depending on the air pressure difference. It is recommended that 5/16–18 self-tapping bolts be used every 22 inches for all pressure conditions which thereby eliminates about 75 percent of the number of holes needed to be drilled to accommodate the installation of the present invention.

The spoke to hub connection uses four 1/2–13 socket head bolts and guide pins to accurately and efficiently attach the primary spokes to the precision machined hub surface and thereby eliminating any time consuming line up procedure, etc., for a proper installation.

The rim joints make it real easy and fast to install the media without the use of any cumbersome tooling that would have to be installed, removed, stored and reinstalled for every rim that is pulled tight.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

Now that the invention has been described,

What is claimed is:

1. A rotary wheel system comprising:

a rotatable frame having a rotation axis;

an energy transfer matrix comprising a plurality of removable, interchangeable media segments;

the rotatable frame including:

a hub assembly having a circular portion;

a plurality of spokes radially extending from said circular portion of the hub assembly, in between which each media segment is located, each spoke generally having an I-beam cross-section with two spaced-apart flanges perpendicular to a center section;

hub joint means for fastening each spoke to a portion of the circular portion of the hub assembly;

a rim assembly, the rim assembly including a plurality of rim segments;

rim joint fastening means for fastening each end of each rim segment to one of the plurality of spokes;

each of the plurality of spokes further including two spaced-apart slots at an end of the center section, each slot having a fastening member fixed therein aligned so as to engage with the rim joint fastening means;

each rim joint fastening means including a spoke rim bracket member having a surface interfacing with said end of the center section of a spoke; and the spoke rim bracket member having two spaced-apart apertures into which bolts are inserted for fastening the spoke rim bracket member to the fastening members in each center section slot;

each rim joint fastening means further including a pair of rim segment retaining brackets, each being generally L-shaped with two spaced-apart apertures on one of a leg of each of the L-shaped rim segment retaining brackets through which fasteners are inserted to secure one end of one of the rim segments to the spoke rim bracket member and to secure one end of an adjacent rim segment to the spoke rim bracket member;

wherein each media segment is compressed within a generally pie-shaped formed portion of the rotatable frame bounded by the hub assembly, two radially extending spokes and one of the rim segments.

2. The rotary wheel system according to claim 1, wherein each rim joint fastening means further comprises:

a longitudinal semicircular recess on two corners of each spoke rim bracket member on the spoke side of the spoke rim bracket member;

a circular rod positioned in each recess;

two spaced-apart threaded holes in each rod;

each spoke rim bracket member further having four spaced-apart diagonal bores, two on each side of the each spoke rim bracket member, the bores aligned to enter the semicircular recesses, wherein fasteners which secure each end of adjacent rim segments to the spoke rim bracket member are inserted through the diagonal bores and threaded into the threaded holes in the circular rod.

3. The rotary wheel system according to claim 2, wherein the four spaced-apart diagonal bores extend through the spoke rim bracket member at an angle of from about 25 degrees to about 30 degrees relative to each end of the adjacent rim segments.

4. The rotary wheel system according to claim 2, wherein each spoke rim bracket member has a longitudinal recessed portion of sufficient depth such that heads of the bolts fastened into the center section of the spoke underlie each end of adjacent rim segments attached to said spoke rim bracket member.

5. The rotary wheel system according to claim 3, wherein each spoke rim bracket member further has an intermediate recessed portion perpendicular to the longitudinal recessed portion, said intermediate recessed portion being of sufficient depth so as to underlie belt drive grooves in each adjacent rim segment attached to said spoke rim bracket member.

6. The rotary wheel system according to claim 1, wherein the leg of each L-shaped rim segment retaining bracket with the two spaced-apart holes through which fasteners are inserted to secure the one end of one of the rim segments to the spoke rim bracket member and to secure the one end of the adjacent rim segment to the spoke rim bracket member further has a recessed portion of sufficient depth so as to underlie one or more belt drive grooves in each adjacent rim segment attached to said spoke rim bracket member.

7. The rotary wheel system according to claim 1, wherein the rotatable frame further comprises:

a plurality of spokes radially extending from said circular portion of the hub assembly, in between which each media segment is located;

each spoke being formed of a primary spoke and a secondary spoke, separated along the center section;

each primary spoke being fixed at one end to hub joint means for fastening the primary spoke to a portion of the circular portion of the hub assembly; and fastening means for joining each secondary spoke to each respective primary spoke.

8. The rotary wheel system according to claim 7, wherein each primary spoke has two spaced-apart opposed recesses running longitudinally substantially from the one end of the center section of the primary spoke fixed to the hub joint means to an opposite end of the center section of the primary spoke.

9. The rotary wheel system according to claim 6, each primary spoke further comprises:

two spaced-apart slots at the opposite end of the center section, each slot having a fastening member fixed therein aligned so as to engage with the rim joint fastening means.

10. The rotary wheel system according to claim 7, wherein inside surfaces of each side of the primary and secondary spokes include serrations against which segments of the media matrix is compressed for preventing movement of the matrix segments during operation of the rotary wheel system.

11. The rotary wheel system according to claim 7, wherein each segment of the media matrix is compressed so as to be squeezed within each recess of the primary spoke bounding and facing the segment of the media matrix.

12. The rotary wheel system according to claim 7, wherein the fastening means for joining each secondary spoke to its corresponding primary spoke is a plurality of spaced-apart bolts secured from a top of the flange for the secondary spoke through said flange into the center section of the spoke.

13. The rotary wheel system according to claim 1, wherein the hub assembly includes a shaft portion and the circular portion has a continuous surface across which the hub joint means interfaces.

14. The rotary wheel system according to claim 1, wherein the hub assembly includes a shaft portion and the circular portion is comprised of two spaced-apart circular disc, an outer surface of each disc being circular, the hub joint means interfacing with said outer surfaces and extending from one disc to the other.

15. The rotary wheel system according to claim 1, wherein the hub joint means comprises:

a spoke support structural member;

the spoke support structural member having a groove portion at an approximate center of said spoke support structural member, said groove portion extending longitudinally across said spoke support structural member, the groove portion for receiving and fixing thereto the primary spoke;

the spoke support structural member further having an arcuate surface for interfacing with the circular portion of the hub assembly; and the arcuate surface having an alignment groove in which two spaced-apart alignment pins, each fixed to the circular portion of the hub assembly extend into the alignment groove, wherein the spoke support structural member is fastened to the circular portion of the hub assembly.

16. The rotary wheel system according to claim 7, wherein the fastening means for joining each secondary spoke to its corresponding primary spoke is a plurality of spaced-apart bolts secured from a top of the flange for the secondary spoke through said flange into the center section of the spoke.

17. The rotary wheel system according to claim 1, wherein each rim segment is arcuate-shaped with a generally C-channel configuration, each rim segment further having one or more belt drive grooves approximately centered and extending from one end of each segment to another end of said segment.

18. The rotary wheel system according to claim 6, wherein each rim segment is arcuate-shaped with a generally C-channel configuration, and the one or more belt drive grooves in each rim segment are approximately centered and extending from one end of each segment to the other end of said segment.

19. The rotary wheel system according to claim 18, wherein spoke rim bracket member further has cut-out portions on each end of said spoke rim bracket member into which a portion of each outside leg of the generally C-shaped channel configured rim segment depends.

20. The rotary wheel system according to claim 17, wherein the rim assembly further comprises:

a generally C-shaped channel member extending generally along the length of each rim segment in an underlying relationship to the rim segment and its one or more belt drive grooves; and the generally C-shaped channel member having a flat surface against which the media segment is compressed.

21. The rotary wheel system according to claim 13, wherein the shaft portion is a detachable split shaft mechanically coupled to each side of the circular portion of the hub assembly.

22. The rotary wheel system according to claim 10, wherein outside surfaces of each side of the primary and secondary spokes include serrations.

23. The rotary wheel system according to claim 1, wherein each leg of the pair of rim segment retainer brackets having the two spaced-apart apertures is arcuate-shaped, said arcuate-shaped leg adapted for mating against a corresponding arcuate-shaped surface of a side portion of the spoke rim bracket member, the mating arcuate-shaped leg and bracket member side portion for facilitating the joining together of the retainer brackets and spoke rim bracket member at difference approach angles.

24. A rotary wheel system comprising:

a rotatable frame having a rotation axis;

an energy transfer matrix comprising a plurality of removable, interchangeable media segments;

the rotatable frame including:

a hub assembly having a circular portion;

a plurality of spokes radially extending from said circular portion of the hub assembly, in between which each media segment is located, each spoke generally having an I-beam cross-section with two spaced-apart flanges perpendicular to a center section;

hub joint means for fastening each spoke to a portion of the circular portion of the hub assembly;

the hub joint means including a spoke support structural member;

the spoke support structural member having a groove portion at an approximate center of said spoke support structural member, said groove portion extending longitudinally across said spoke support structural member, the groove portion for receiving and fixing thereto the primary spoke;

the spoke support structural member further having an arcuate surface for interfacing with the circular portion of the hub assembly;

the arcuate surface having an alignment groove in which two spaced-apart alignment pins, each fixed to the circular portion of the hub assembly, extend into the alignment groove;

the spoke support structural member being fastened to the circular portion of the hub assembly;

a rim assembly, the rim assembly including a plurality of rim segments; and rim joint fastening means for fastening each end of each rim segment to one of the plurality of spokes, wherein each media segment is compressed within a generally pie-shaped formed portion of the rotatable frame bounded by the hub assembly, two radially extending spokes and one of the rim segments.

25. The rotary wheel system according to claim 24, wherein the hub assembly includes a shaft portion and the circular portion has a continuous surface across which the hub joint means interfaces.

26. The rotary wheel system according to claim 24, wherein the hub assembly includes a shaft portion and the circular portion is comprised of two spaced-apart circular disc, an outer surface of each disc being circular, the hub joint means interfacing with said outer surfaces and extending from one disc to the other.

27. The rotary wheel system according to claim 24, wherein the rotatable frame further comprises:

a plurality of spokes radially extending from said circular portion of the hub assembly, in between which each media segment is located;

each spoke being formed of a primary spoke and a secondary spoke, separated along the center section;

each primary spoke being fixed at one end to hub joint means for fastening the primary spoke to a portion of the circular portion of the hub assembly; and fastening means for joining each secondary spoke to each respective primary spoke.

28. The rotary wheel system according to claim 27, wherein each primary spoke has two spaced-apart opposed recesses running longitudinally substantially from the one end of the center section of the primary spoke fixed to the hub joint means to an opposite end of the center section of the primary spoke.

29. The rotary wheel system according to claim 28, each primary spoke further comprises:

two spaced-apart slots at the opposite end of the center section, each slot having a fastening member fixed therein aligned so as to engage with the rim joint fastening means.

30. The rotary wheel system according to claim 27, wherein inside surfaces of each side of the primary and secondary spokes include serrations against which segments of the media matrix is compressed for preventing movement of the matrix segments during operation of the rotary wheel system.

31. The rotary wheel system according to claim 27, wherein each segment of the media matrix is compressed so as to be squeezed within each recess of the primary spoke bounding and facing the segment of the media matrix.

32. The rotary wheel system according to claim 27, wherein the fastening means for joining each secondary spoke to its corresponding primary spoke is a plurality of spaced-apart bolts secured from a top of the flange for the secondary spoke through said flange into the center section of the spoke.

33. The rotary wheel system according to claim 29, wherein each rim joint fastening means comprises:

a spoke rim bracket member having a surface interfacing with said opposite end of the center section of a spoke; and the spoke rim bracket member having two spaced-apart apertures into which bolts are inserted for fastening the spoke rim bracket member to the fastening members in each center section slot.

34. The rotary wheel system according to claim 33, wherein each rim joint fastening means further comprises:

a pair of rim segment retaining brackets, each being generally L-shaped with two spaced-apart apertures on one of a leg of each of the L-shaped rim segment retaining brackets through which fasteners are inserted to secure one end of one of the rim segments to the spoke rim bracket member and to secure one end of an adjacent rim segment to the spoke rim bracket member.

35. The rotary wheel system according to claim 34, wherein each rim joint fastening means further comprises:

a longitudinal semicircular recess on two corners of each spoke rim bracket member on the spoke side of the spoke rim bracket member;

a circular rod positioned in each recess;

two spaced-apart threaded holes in each rod;

each spoke rim bracket member further having four spaced-apart diagonal bores, two on each side of the each spoke rim bracket member, the bores aligned to enter the semicircular recesses, wherein fasteners which secure each end of adjacent rim segments to the spoke rim bracket member are inserted through the diagonal bores and threaded into the threaded holes in the circular rod.

36. The rotary wheel system according to claim 35, wherein the four spaced-apart diagonal bores extend through the spoke rim bracket member at an angle of from about 25 degrees to about 30 degrees relative to each end of the adjacent rim segments.

37. The rotary wheel system according to claim 35, wherein each spoke rim bracket member has a longitudinal recessed portion of sufficient depth such that heads of the bolts fastened into the center section of the spoke underlie each end of adjacent rim segments attached to said spoke rim bracket member.

38. The rotary wheel system according to claim 36, wherein each spoke rim bracket member further has an intermediate recessed portion perpendicular to the longitudinal recessed portion, said intermediate recessed portion being of sufficient depth so as to underlie belt drive grooves in each adjacent rim segment attached to said spoke rim bracket member.

39. The rotary wheel system according to claim 34, wherein the leg of each L-shaped rim segment retaining bracket with the two spaced-apart holes through which fasteners are inserted to secure the one end of one of the rim segments to the spoke rim bracket member and to secure the one end of the adjacent rim segment to the spoke rim bracket member further has a recessed portion of sufficient depth so as to underlie one or more belt drive grooves in each adjacent rim segment attached to said spoke rim bracket member.

40. The rotary wheel system according to claim 24, wherein each rim segment is arcuate-shaped with a generally C-channel configuration, each rim segment further having one or more belt drive grooves approximately centered and extending from one end of each segment to another end of said segment.

41. The rotary wheel system according to claim 39, wherein each rim segment is arcuate-shaped with a generally C-channel configuration, and the one or more belt drive grooves in each rim segment are approximately centered and extending from one end of each segment to the other end of said segment.

42. The rotary wheel system according to claim 41, wherein spoke rim bracket member further has cut-out portions on each end of said spoke rim bracket member into which a portion of each outside leg of the generally C-shaped channel configured rim segment depends.

43. The rotary wheel system according to claim 40, wherein the rim assembly further comprises:

a generally C-shaped channel member extending generally along the length of each rim segment in an underlying relationship to the rim segment and its one or more belt drive grooves; and the generally C-shaped channel member having a flat surface against which the media segment is compressed.

44. The rotary wheel system according to claim 25, wherein the shaft portion is a detachable split shaft mechanically coupled to each side of the circular portion of the hub assembly.

45. The rotary wheel system according to claim 34, wherein each leg of the pair of rim segment retainer brackets having the two spaced-apart apertures is arcuate-shaped, said arcuate-shaped leg adapted for mating against a corresponding arcuate-shaped surface of a side portion of the spoke rim bracket member, the mating arcuate-shaped leg and bracket member side portion for facilitating the joining together of the retainer brackets and spoke rim bracket member at difference approach angles.

46. The rotary wheel system according to claim 30, wherein outside surfaces of each side of the primary and secondary spokes include serrations.

47. A rotary wheel system comprising:

a rotatable frame having a rotation axis;

an energy transfer matrix comprising a plurality of removable, interchangeable media segments;

the rotatable frame including:

a hub assembly having a circular portion;

a plurality of spokes radially extending from said circular portion of the hub assembly, in between which each media segment is located;

each spoke generally having an I-beam cross-section with two spaced-apart flanges perpendicular to a center section, each spoke being formed of a primary spoke and a secondary spoke, separated along the center section;

each primary spoke being fixed at one end to hub joint means for fastening the primary spoke to a portion of the circular portion of the hub assembly;

fastening means for joining each secondary spoke to each respective primary spoke;

a rim assembly, the rim assembly including a plurality of rim segments; and rim joint fastening means for fastening each end of each rim segment to one of the plurality of spokes, wherein each media segment is compressed within a generally pie-shaped formed portion of the rotatable frame bounded by the hub assembly, two radially extending spokes and one of the rim segments.

48. The rotary wheel system according to claim 47, wherein each primary spoke has two spaced-apart opposed recesses running longitudinally substantially from the one end of the center section of the primary spoke fixed to the hub joint means to an opposite end of the center section of the primary spoke.

49. The rotary wheel system according to claim 48, wherein each primary spoke further comprises:

two spaced-apart slots at the opposite end of the center section, each slot having a fastening member fixed therein aligned so as to engage with the rim joint fastening means.

50. The rotary wheel system according to claim 47, wherein inside surfaces of each side of the primary and secondary spokes include serrations against which segments of the media matrix is compressed for preventing movement of the matrix segments during operation of the rotary wheel system.

51. The rotary wheel system according to claim 48, wherein each segment of the media matrix is compressed so as to be squeezed within each recess of the primary spoke bounding and facing the segment of the media matrix.

52. The rotary wheel system according to claim 47, wherein the hub assembly includes a shaft portion and the circular portion has a continuous surface across which the hub joint means interfaces.

53. The rotary wheel system according to claim 47, wherein the hub assembly includes a shaft portion and the circular portion is comprised of two spaced-apart circular disc, an outer surface of each disc being circular, the hub joint means interfacing with said outer surfaces and extending from one disc to the other.

54. The rotary wheel system according to claim 47, wherein the hub joint means comprises:

a spoke support structural member;

the spoke support structural member having a groove portion at an approximate center of said spoke support structural member, said groove portion extending longitudinally across said spoke support structural member, the groove portion for receiving and fixing thereto the primary spoke;

the spoke support structural member further having an arcuate surface for interfacing with the circular portion of the hub assembly; and the arcuate surface having an alignment groove in which two spaced-apart alignment pins, each fixed to the circular portion of the hub assembly extend into the alignment groove, wherein the spoke support structural member is fastened to the circular portion of the hub assembly.

55. The rotary wheel system according to claim 47, wherein the fastening means for joining each secondary spoke to its corresponding primary spoke is a plurality of spaced-apart bolts secured from a top of the flange for the secondary spoke through said flange into the center section of the spoke.

56. The rotary wheel system according to claim 49, wherein each rim joint fastening means comprises:

a spoke rim bracket member having a surface interfacing with said opposite end of the center section of a spoke; and the spoke rim bracket member having two spaced-apart apertures into which bolts are inserted for fastening the spoke rim bracket member to the fastening members in each center section slot.

57. The rotary wheel system according to claim 56, wherein each rim joint fastening means further comprises:

a pair of rim segment retaining brackets, each being generally L-shaped with two spaced-apart apertures on one of a leg of each of the L-shaped rim segment retaining brackets through which fasteners are inserted to secure one end of one of the rim segments to the spoke rim bracket member and to secure one end of an adjacent rim segment to the spoke rim bracket member.

58. The rotary wheel system according to claim 57, wherein each rim joint fastening means further comprises:

a longitudinal semicircular recess on two corners of each spoke rim bracket member on the spoke side of the spoke rim bracket member;

a circular rod positioned in each recess;

two spaced-apart threaded holes in each rod;

each spoke rim bracket member further having four spaced-apart diagonal bores, two on each side of the each spoke rim bracket member, the bores aligned to enter the semicircular recesses, wherein fasteners which secure each end of adjacent rim segments to the spoke rim bracket member are inserted through the diagonal bores and threaded into the threaded holes in the circular rod.

59. The rotary wheel system according to claim 58, wherein the four spaced-apart diagonal bores extend through the spoke rim bracket member at an angle of from about 25 degrees to about 30 degrees relative to each end of the adjacent rim segments.

60. The rotary wheel system according to claim 58, wherein each spoke rim bracket member has a longitudinal recessed portion of sufficient depth such that heads of the bolts fastened into the center section of the spoke underlie each end of adjacent rim segments attached to said spoke rim bracket member.

61. The rotary wheel system according to claim 59, wherein each spoke rim bracket member further has an intermediate recessed portion perpendicular to the longitudinal recessed portion, said intermediate recessed portion being of sufficient depth so as to underlie belt drive grooves in each adjacent rim segment attached to said spoke rim bracket member.

62. The rotary wheel system according to claim 57, wherein the leg of each L-shaped rim segment retaining bracket with the two spaced-apart holes through which fasteners are inserted to secure the one end of one of the rim segments to the spoke rim bracket member and to secure the one end of the adjacent rim segment to the spoke rim bracket member further has a recessed portion of sufficient depth so as to underlie one or more belt drive grooves in each adjacent rim segment attached to said spoke rim bracket member.

63. The rotary wheel system according to claim 47, wherein each rim segment is arcuate-shaped with a generally C-channel configuration, each rim segment further having one or more belt drive grooves approximately centered and extending from one end of each segment to another end of said segment.

64. The rotary wheel system according to claim 62, wherein each rim segment is arcuate-shaped with a generally C-channel configuration, and the one or more belt drive grooves in each rim segment are approximately centered and extending from one end of each segment to the other end of said segment.

65. The rotary wheel system according to claim 64, wherein spoke rim bracket member further has cut-out portions on each end of said spoke rim bracket member into which a portion of each outside leg of the generally C-shaped channel configured rim segment depends.

66. The rotary wheel system according to claim 63, wherein the rim assembly further comprises:

a generally C-shaped channel member extending generally along the length of each rim segment in an underlying relationship to the rim segment and its one or more belt drive grooves; and the generally C-shaped channel member having a flat surface against which the media segment is compressed.

67. The rotary wheel system according to claim 52, wherein the shaft portion is a detachable split shaft mechanically coupled to each side of the circular portion of the hub assembly.

68. The rotary wheel system according to claim 57, wherein each leg of the pair of rim segment retainer brackets having the two spaced-apart apertures is arcuate-shaped, said arcuate-shaped leg adapted for mating against a corresponding arcuate-shaped surface of a side portion of the spoke rim bracket member, the mating arcuate-shaped leg and bracket member side portion for facilitating the joining together of the retainer brackets and spoke rim bracket member at difference approach angles.

69. The rotary wheel system according to claim 50, wherein outside surfaces of each side of the primary and secondary spokes include serrations.

* * * * *